US008405195B2

(12) United States Patent
Starovecký

(10) Patent No.: US 8,405,195 B2
(45) Date of Patent: Mar. 26, 2013

(54) ARRANGEMENT COMPRISING AT LEAST ONE POWER SEMICONDUCTOR MODULE AND A TRANSPORT PACKAGING

(75) Inventor: Stefan Starovecký, Piestany (SK)

(73) Assignee: Semikron Elektronik GmbH & Co., KG, Nürnberg (DE)

( * ) Notice: Subject to any disclaimer, the term of this patent is extended or adjusted under 35 U.S.C. 154(b) by 246 days.

(21) Appl. No.: 13/010,637

(22) Filed: Jan. 20, 2011

(65) Prior Publication Data

US 2011/0203967 A1 Aug. 25, 2011

(30) Foreign Application Priority Data

Jan. 20, 2010 (DE) ..... 10 2010 005 048

(51) Int. Cl.
*H01L 23/02* (2006.01)

(52) U.S. Cl. ..... 257/678; 257/798; 257/691; 206/710; 206/711

(58) Field of Classification Search ..... 257/678, 257/704, 723, 724, 798, 691; 206/710, 711, 206/714, 716, 832, 564
See application file for complete search history.

(56) References Cited

U.S. PATENT DOCUMENTS

| | | | | |
|---|---|---|---|---|
| 4,654,693 | A * | 3/1987 | Funakoshi et al. | 269/287 |
| 5,234,105 | A | 8/1993 | Sato et al. | |
| 6,244,442 | B1 | 6/2001 | Inoue et al. | |
| 6,540,073 | B1 | 4/2003 | Hagel et al. | |
| 6,653,728 | B1 * | 11/2003 | Jhong et al. | 257/697 |
| 2002/0066694 | A1 * | 6/2002 | Soh et al. | 206/725 |
| 2003/0019784 | A1 | 1/2003 | Pylant | |
| 2005/0269242 | A1 * | 12/2005 | Crisp | 206/710 |
| 2008/0252317 | A1 * | 10/2008 | Hopkins et al. | 324/755 |
| 2009/0090653 | A1 * | 4/2009 | Forsyth | 206/710 |
| 2009/0176333 | A1 * | 7/2009 | Matsubara et al. | 438/113 |
| 2011/0183496 | A1 * | 7/2011 | Kaneko | 438/473 |
| 2012/0043253 | A1 * | 2/2012 | Jeong et al. | 206/710 |

FOREIGN PATENT DOCUMENTS

| | | |
|---|---|---|
| CA | 2264339 | 3/1999 |
| DE | 39 09 898 | 9/1990 |
| DE | 199 28 368 | 12/1999 |

* cited by examiner

*Primary Examiner* — S. V. Clark
(74) *Attorney, Agent, or Firm* — The Law Offices of Roger S. Thompson

(57) ABSTRACT

An arrangement comprising: at least one power semiconductor module and a transport packaging. The power semiconductor module has a base element, a housing and connection elements. The transport packaging has a cover layer, an interlayer with a respective cutout assigned to the power semiconductor module, and a cover film. The cover layer is generally planar, and has a first main surface facing the power semiconductor module. The interlayer is arranged on the first main surface of the cover layer. The power semiconductor module is arranged in the cutout, on the first main surface of the cover layer, wherein the base element of the power semiconductor module is disposed on the first main surface of the cover layer. The cover film bears on and covers substantial parts of the housing of the power semiconductor module. The cover film is connected to the first main surface of the interlayer.

19 Claims, 3 Drawing Sheets

Fig. 1a
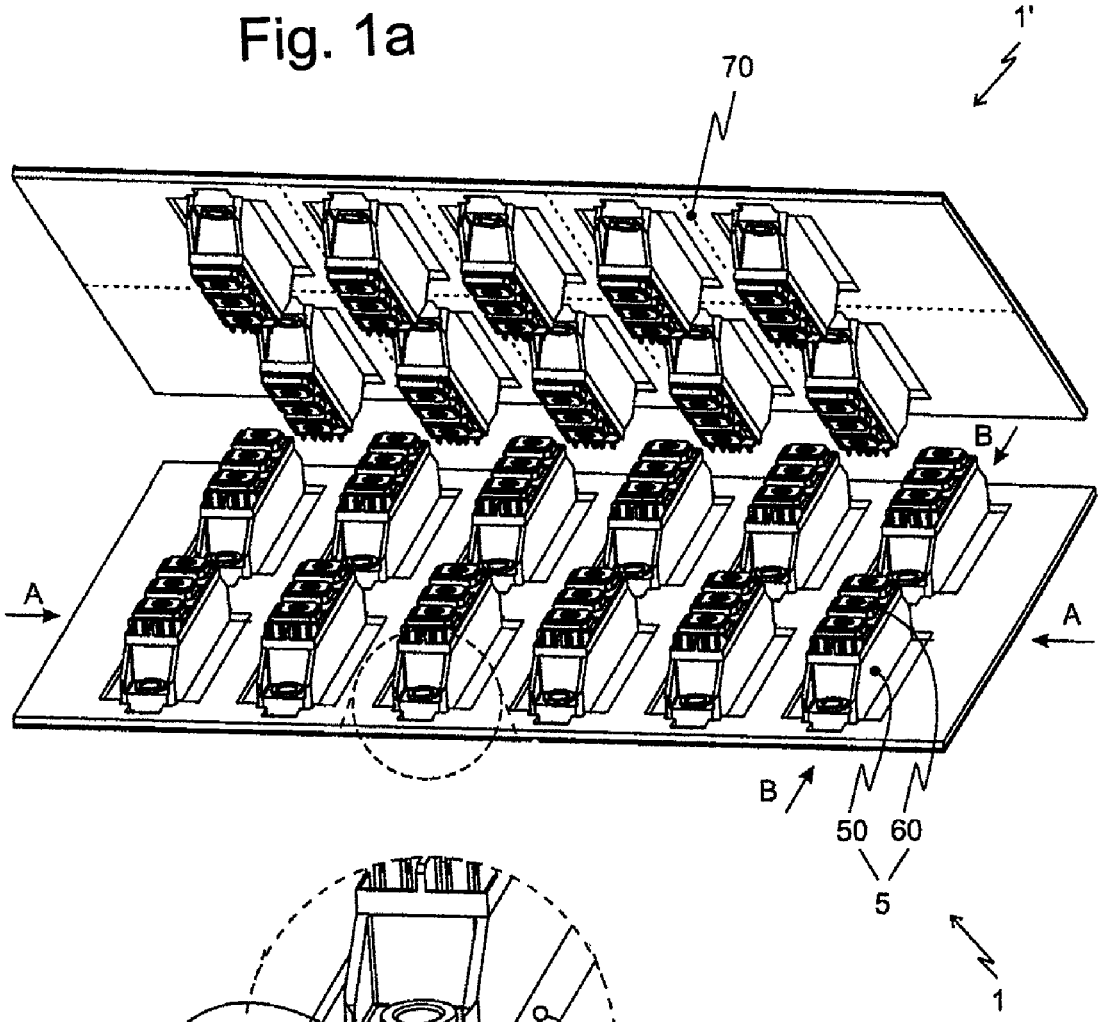
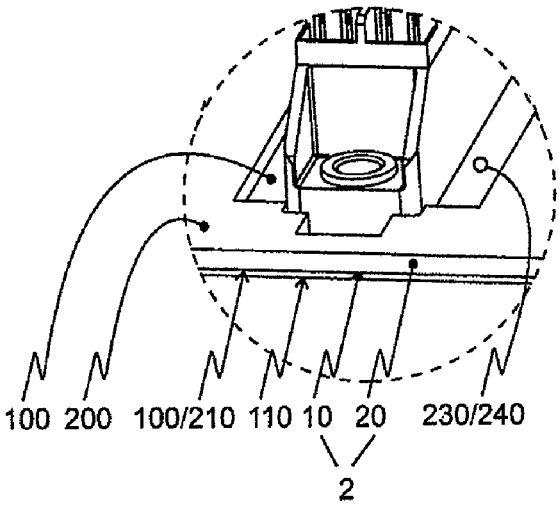
Fig. 1b

ARRANGEMENT COMPRISING AT LEAST ONE POWER SEMICONDUCTOR MODULE AND A TRANSPORT PACKAGING

BACKGROUND OF THE INVENTION

1. Field of the Invention

The invention describes an arrangement for mainly ex-works transport of at least one power semiconductor module, preferably arranged in a one- or two-dimensional matrix in a transport packaging.

2. Description of the Related Art

In principle, a large number of different transport packagings for power semiconductor modules, such as simple cardboard boxes or plastic blisters having a base body and cover, are known. So-called skin packagings are known from the packaging of goods for end consumers. Simple cardboard boxes, for example in accordance with DE 39 09 898 A1, generally have the disadvantage that they do not protect the power semiconductor modules sufficiently against mechanical damage during transport. A further disadvantage is that such packaging has to be opened, for example for customs inspections and, consequently, the power semiconductor modules can be touched directly, which may possibly lead to damage from electrostatic discharge or due to the touching of sensitive surfaces, for example silver-coated connection elements.

The so-called skin packagings such as are known from DE 199 28 368 A1, for example, form a starting point of this invention and are a combination of a cardboard box with a plastic film enclosing the product to be packaged. As is known, such packagings have the significant disadvantage that they do not permit opening the packaging and removing the packaged product easily.

SUMMARY OF THE INVENTION

It is an object of the invention to provide an arrangement comprising: at least one power semiconductor module and a transport packaging, wherein the latter, at least in combination with a further external packaging, is particularly robust against mechanical damage that may occur during transport, and is also accessible, in principle, to protection against electrostatic discharge. The arrangement also permits reading identification applied to the at least one power semiconductor module, without having to open the transport packaging, wherein removal of the power semiconductor module from the transport package is made simple and does not require a tool.

The inventive concept is based on the skin packaging mentioned above. The latter is developed to form an arrangement comprising at least one power semiconductor module. In this case, this arrangement has at least one power semiconductor module, but preferably a plurality of power semiconductor modules, arranged in a one- or two-dimensional matrix, and a transport packaging.

In its preferred embodiment, the power semiconductor module has a base element, preferably a metallic baseplate, a housing composed of an insulating material and connection elements for externally making contact with the power semiconductor components arranged internally in an insulated fashion with respect to the baseplate. In this case, the term power semiconductor module should be understood to mean, in addition to these power semiconductor modules constructed in an electrically insulated fashion in relation to the base element, also disc-type thyristors, such as have long being part of the prior art and have two planar connection elements and an insulating material body composed of ceramic or plastic arranged therebetween. The transport packaging of the arrangement according to the invention has, for its part, a cover layer, an interlayer with a respective cutout assigned to the at least one power semiconductor module, and a cover film. The cover layer, preferably embodied as composite cardboard that is dissipative in its entirety, is generally planar and thus forms the base of the transport packaging. The at least one power semiconductor module is arranged on a first main surface of the cover layer, preferably by virtue of the base element of the power semiconductor module becoming situated on the first main surface of the cover layer.

The interlayer is likewise arranged on the first main surface of the cover layer, wherein an assigned power semiconductor module is arranged in the respective cutout of the interlayer and projects beyond the interlayer in the direction of its first main surface. In this case, it is particularly preferred if the edge of the cutout of the interlayer bears only to the extent of at most 50%, preferably only to the extent of at most 25%, directly against the assigned power semiconductor module and the remaining part of the edge is at a distance from the power semiconductor module. Advantageously, the connection of the first main surface of the cover layer to the second main surface of the interlayer is embodied as a detachable connection, preferably as a detachable adhesive-bonding connection.

The cover film covers substantial parts of the power semiconductor module and in this case bears substantially against the housing and the parts that do not become situated on the first main surface of the cover layer, such as, for example, the connection elements of the power semiconductor module. Furthermore, the cover film is preferably adhesively connected to the first main surface of the interlayer. In this case, it is preferred if the cover layer and the interlayer have a detachable connection with a lower adhesive force than the connection of the interlayer and the cover film, since, in order to remove the power semiconductor module, the cover layer is intended to be separated from the interlayer. Likewise, for reasons of stability, it may also be preferred for the cover film to be detachably connected, to an intermediate region of the first main surface of the cover layer, the intermediate region being cut free by the respective cutout of the interlayer alongside the power semiconductor component.

For the protection of the power semiconductor modules against electrostatic discharge it is preferred if the cover film consists of a conductive or dissipative plastic film with or without a metal-vapor-deposited outer surface. It is likewise advantageous for the cover film to be at least partially transparent at least in sections, but preferably substantially completely transparent.

The configuration of the inventive arrangement makes it possible

- to fix the packaged power semiconductor modules mechanically in relation to one another and at a distance from one another;
- to read identification applied on each power semiconductor module, including by means of optoelectronic aids such as handheld scanners, without having to open the transport packaging;
- to form the transport packaging as protection against electrostatic charging;
- to form the transport packaging as protection against direct action on the power semiconductor module, including by harmful gases from the environment, wherein it may furthermore be advantageous to provide a corrosion inhibitor for protecting the connection elements of the power semiconductor module on those sections of the cover layer and/or of the cover film which enclose the power semiconductor module;

to allow simple removal even of just a single power semiconductor module from the transport packaging; and to ensure simple and environmentally friendly disposal of the packaging by the separation thereof, and also by virtue of the small volume and low mass by comparison with other packagings.

A further preferred embodiment arises if, in the case of a plurality of power semiconductor modules arranged in a one- or two-dimensional matrix, the power semiconductor modules are separated from one another, in at least one dimension parallel to the main surface of the cover layer and parallel to a normal to the surface of the housings, by a distance that is greater than the width of the housing in that dimension. It is thus possible to combine two arrangements of this type with the first main surfaces of the cover surfaces facing towards one another and offset relative to one another by roughly half the distance between adjacent power semiconductor modules, to form an overall arrangement having a high packaging density of power semiconductor modules.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The inventive solution will be explained further on the basis of the exemplary embodiments in FIGS. 1 to 4.

FIG. 1*a* shows a perspective view of two arrangements according to the invention;

FIG. 1*b* shows a detail of a portion of FIG. 1*a* shown within a dashed circle;

DETAILED DESCRIPTION OF THE PRESENTLY PREFERRED EMBODIMENTS

Figure 2:
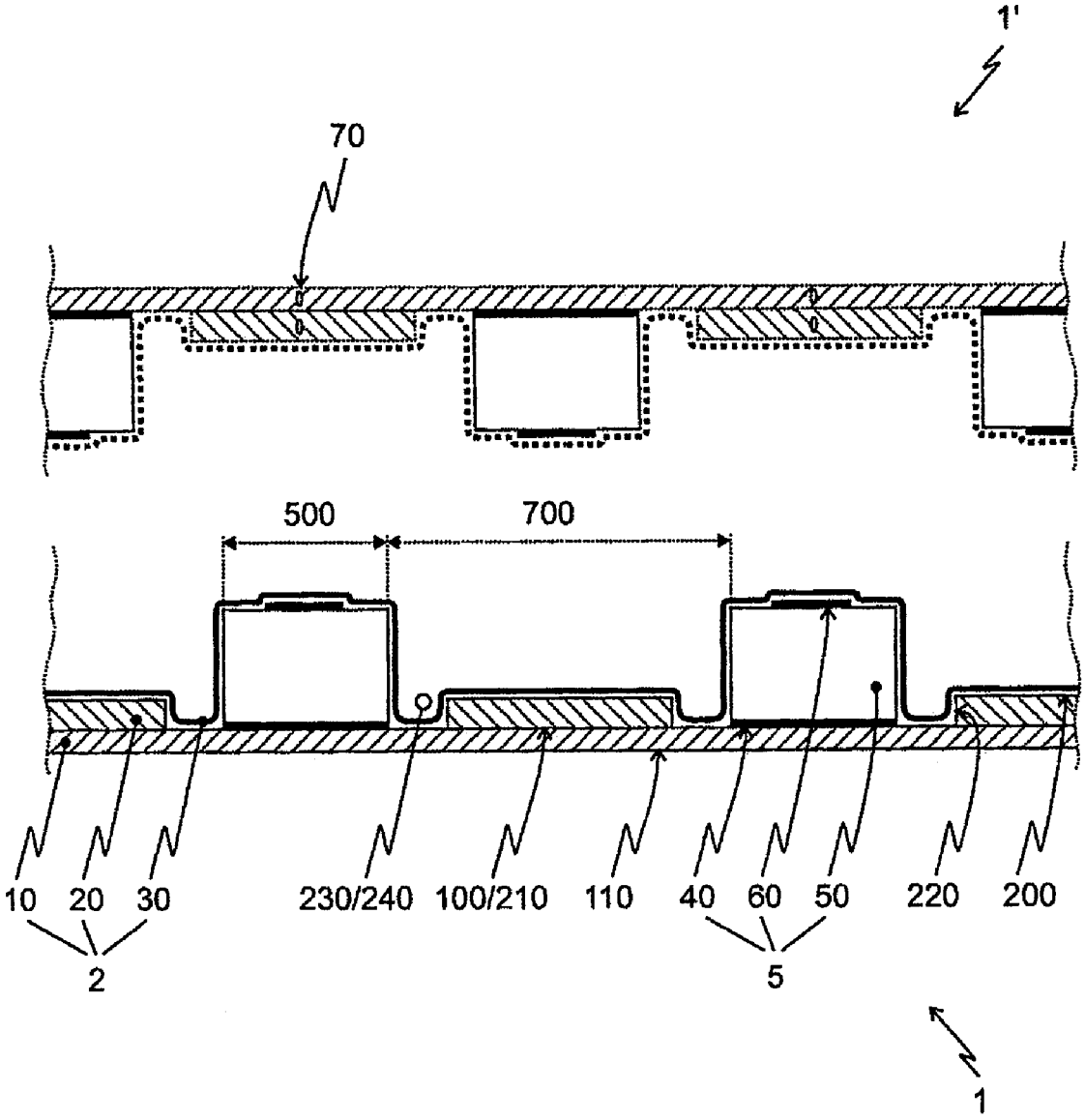
FIG. 2 shows a section through an arrangement according to the invention.

FIG. 1 shows a perspective view of two arrangements 1, 1' according to the invention. Each arrangement comprises a transport packaging 2 and a plurality of power semiconductor modules 5. Each power semiconductor module includes a housing 50 and a plurality of connection elements 60. By their—not visible—base element (40, see FIG. 2), here a metallic baseplate, power semiconductor modules 5 are arranged in a two-dimensional matrix on a first main surface 100 of a cover layer 10 of respective transport packaging 2 by virtue of the base element becoming directly disposed thereon.

An interlayer 20 is arranged by a second main surface 210 on said first main surface 100 of cover layer 10. Interlayer 20 has a plurality of cutouts 230 each assigned to a respective power semiconductor module 5. Each power semiconductor module 5 is arranged in a respective cutout 230 so that an edge 220 of the cutout 230 bears directly against housing 50 at only at a few sections. A spacing is predominantly provided between housing 50 and edge 220, the spacing forming an intermediate region 240.

The transparent cover film 30, encloses the power semiconductor modules 5 with the exception of their base elements 40 and is connected to second main surface 210 of interlayer 20 by adhesive bonding technology. Transparent cover film 30 is not shown in FIG. 1 (see FIGS. 3 and 4). In the case of a plurality—illustrated here—of power semiconductor modules 5 arranged in a two-dimensional matrix, it is furthermore advantageous, just as in the case of a one-dimensional arrangement, if transport packaging 2, has a perforation 70 between respective power semiconductor components 5 to simplify the singulation of packaged power semiconductor modules 5.

FIG. 2 shows, as an excerpt, a section along the line A-A through the embodiment of the inventive arrangement 1 shown in FIG. 1. Here, cover layer 10 is shown with its first 100 and second main surface 110. Power semiconductor modules 5 to be packaged are arranged on first main surface 100 of cover layer 10 in a matrix at a substantially identical distance from one another. Only a base element 40, a housing 50 and a connection element 60 of the power semiconductor modules 5 to be packaged are illustrated.

It is advantageous to arrange power semiconductor modules 5 by their base element 40 which may usually be a metallic baseplate or else directly the substrate of the internal circuit, on first main surface 100 of cover layer 10. However, this is not necessary. Power semiconductor modules 5 may be rotated by 90° or 180° about their respective longitudinal axes. In the illustrated embodiment, connection elements 60 lie on the side of power semiconductor module 5 opposite to cover layer 10.

Interlayer 20 is furthermore illustrated. Second main surface 210 is detachably connected to first main surface 100 of cover layer 10. Preferably, but non-restrictively, interlayer 20 like cover layer 10, consists of paperboard or cardboard or composite cardboard. It has proved to be particularly advantageous for protection against electrostatic discharge to form interlayer 20 and, but preferably only, cover layer 10 of conductive or dissipative composite cardboard. The latter then has a conductive or dissipative film interlayer, for example.

Interlayer 20 furthermore has cutouts 230, as a result of which respective power semiconductor modules 5 are encompassed in the lower region of interlayer 20, but not enclosed directly and completely in a bearing manner. On the entire periphery of the power semiconductor module 5, edge 220 of cutout 230 bears to the extent of no more that approximately 50%, preferably no more that approximately 25%, directly against the respective power semiconductor module 5 and the remaining part of edge 220 is at a distance of at least about 2 mm from power semiconductor module 5 and thereby forming an intermediate region 240. However, direct bearing is necessary at least at some locations, preferably in the corners of the power semiconductor module 5, see FIG. 1, to ensure fixing of power semiconductor modules 5 in position.

Here, exclusively for the sake of clarity, cover film 30 is illustrated as spaced apart from cover layer 10 and interlayer 20 is also spaced apart from power semiconductor modules 5. Moreover, cover film 30 is connected to first main surface 200 of interlayer 20 by adhesive bonding. A connection to first main surface 100 of cover layer 10 is likewise advisable in intermediate region 240, particularly if power semiconductor modules 5 are relatively heavy. This connection can be provided as an alternative, or in addition, to the detachable connection of cover layer 10 and interlayer 20. Cover film 30, insofar as is permitted by its flexibility, bears against power semiconductor modules 5 and encloses them in each case towards cover layer 10.

Typical dimensions of power semiconductor modules 5 mentioned are, without deriving a restriction therefrom, a length in the range of from about 3 cm to about 15 cm given a width 500 and a height of from about 1 cm to about 6 cm. Cover layer 10 of transport packaging 2 has a typical thickness of from about 0.2 mm to about 1 mm, interlayer 20 has a thickness of about 0.5 to about 3 mm, while cover film 30 has a thickness of the order of magnitude of 100 μm.

Cover film 30 may be formed from a conductive or dissipative plastic film with or without a metal-vapor-deposited outer surface. Cover layer 10 may be formed from a conductive or dissipative composite cardboard. This structure provides a transport packaging 2 that affords sufficient protection against electrostatic charging. Since cover film 30 is at least partially transparent, at least in sections, but preferably completely transparent, it is not necessary to open this protective packaging to read any identification thereon.

The inventive arrangement 1 shown in FIG. 2 is furthermore configured so that a distance 700 between adjacent power semiconductor modules 5 is greater than the width 500 of a single power semiconductor module 5, as a result of which, it is possible to provide a second arrangement 1'—illustrated in a dotted fashion—in a manner offset by half the distance with respect to the first arrangement 1 and in a manner rotated by 180°, cf. FIG. 1, thus resulting in a compact overall arrangement having a high packing density with at the same time sufficient fixing of individual power semiconductor modules 5 with respect to one another.

Figure 3:
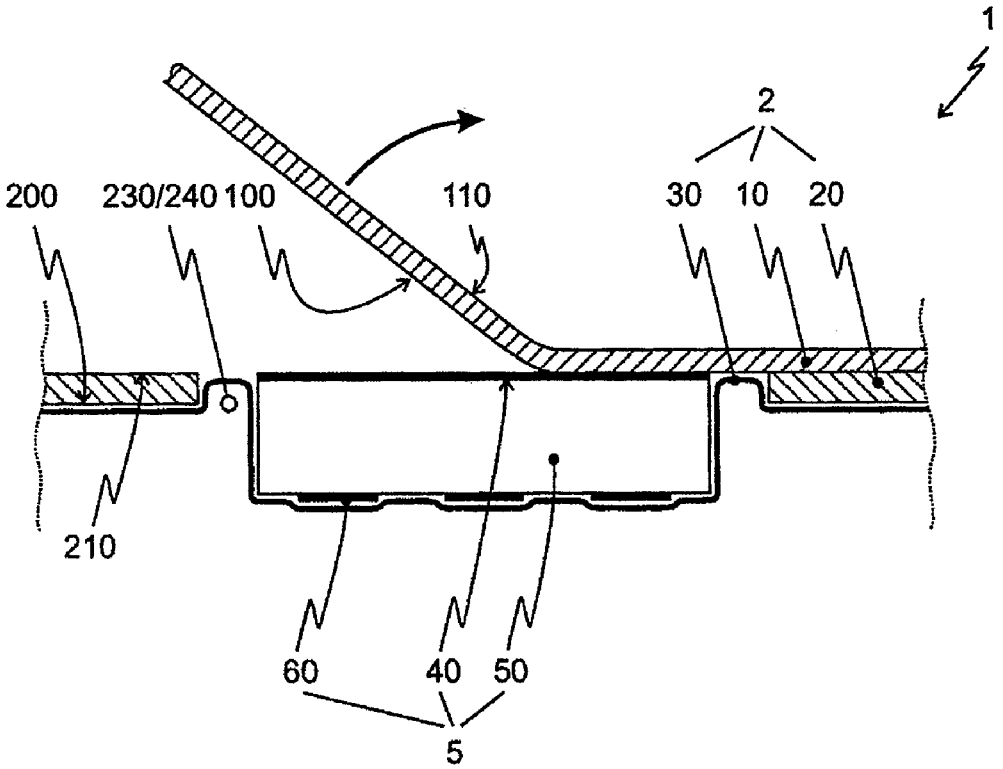
FIGS. 3 and 4 show a further section through an arrangement according to the invention.
Figure 4:
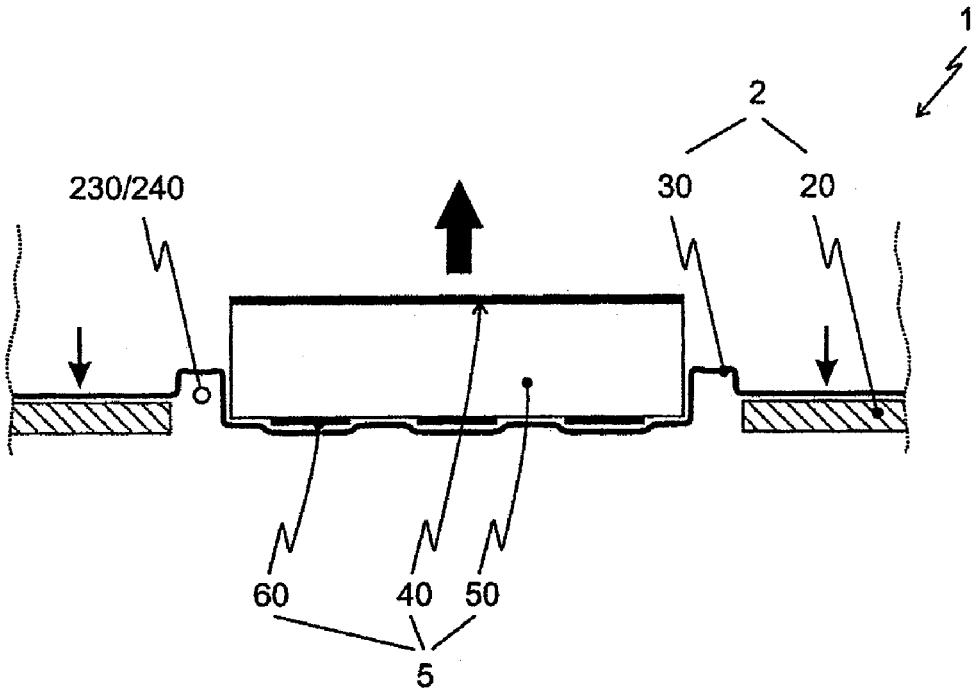

FIGS. 3 and 4 show a further section along the line B-B in FIG. 1 through an arrangement 1 according to the invention in accordance with FIG. 1, wherein a particular advantage of the arrangement becomes evident. FIG. 3 once again shows a power semiconductor module 5 and also a part of transport packaging 2. In this case, however, cover layer 10 is shown as partly separated from interlayer 20. This illustration corresponds to the opening of transport packaging 2 to remove a power semiconductor module 5 therefrom. In this case, the detachable connection between cover layer 10 and interlayer 20 and/or that between cover layer 10 and cover film 30 are/is separated in intermediate region 240.

It is particularly advantageous in this case if the detachable connection between cover layer 10 and interlayer 20 has a lower adhesive force than the connection of interlayer 20 and cover film 30. It is likewise advantageous if cover layer 10 is embodied such that it is thinner and hence mechanically less rigid than interlayer 20, since interlayer 20 thus remains virtually as a holding frame for the rest of transport packaging 2.

FIG. 4 then shows a further step of removing a power semiconductor module 5 from transport packaging 2. In this case, interlayer 20 was pressed in the direction of the surface normal to its first main surface 200 until interlayer 20 lies approximately on the plane formed by the top side of the housing 50. During this displacement of interlayer 20, cover film 30 detaches at least partly from the housing 50 of the power semiconductor module 5 as a result of which the latter can be removed from the transport packaging 2 in a simple manner and without using a tool.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve substantially the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An arrangement comprising:

at least one power semiconductor module having a base element, a housing and connection elements; and a transport packaging having a generally planar cover layer, said cover layer including a first main surface facing said at least one power semiconductor module;

an interlayer with a respective cutout assigned to each of said at least one power semiconductor modules, and including a second main surface disposed on said first main surface of said cover layer; and a cover film;

wherein said at least one power semiconductor module is arranged in said at least one cutout on said first main surface of said cover layer and, consequently, becomes situated on said first main surface of the cover layer, wherein said cover film covers substantial parts of said at least one power semiconductor module, and therefore bears substantially against said housing, and wherein said cover film is connected to said first main surface of said interlayer.

2. The arrangement of claim 1, wherein said cover layer and said interlayer are detachably connected.

3. The arrangement of claim 1, wherein said cover film is detachably connected to said first main surface of said cover layer in an intermediate region cut free by a respective one of said at least one cutout alongside a respective one of said at least one power semiconductor component.

4. The arrangement of claim 1, wherein said at least one power semiconductor module is a plurality of power semiconductor modules arranged in a matrix; and wherein adjacent ones of said plurality of power semiconductor modules are separated from one another, in at least one direction parallel to said first main surface of said cover layer and parallel to a normal to the surface of said housing, by a distance that is greater than a width of said housing in said direction.

5. The arrangement of claim 1, wherein said at least one power semiconductor module is a plurality of power semiconductor modules arranged in a matrix; and wherein said transport packaging includes a perforation between adjacent ones of said power semiconductor components.

6. The arrangement of claim 1, wherein said cover film is a plastic film.

7. The arrangement of claim 6, wherein said cover film is a conductive plastic film

8. The arrangement of claim 6, wherein said cover film is a dissipative plastic film.

9. The arrangement of claim 6, wherein said cover film has a metal-vapor-deposited outer surface.

10. The arrangement of claim 1, wherein said cover film is at least partly transparent at least in sections.

11. The arrangement of claim 10, wherein said cover film is substantially completely transparent.

12. The arrangement of claim 1, wherein at least one of said interlayer and said cover layer is formed of a material selected from the group consisting of paperboard, cardboard and composite cardboard.

13. The arrangement of claim 1, wherein at least one of said interlayer and said cover layer is conductive.

14. The arrangement of claim 1, wherein at least one of said interlayer and said cover layer is dissipative.

15. The arrangement of claim 2, wherein the detachable connection between said cover layer and said interlayer has a lower adhesive force than the connection between said interlayer and said cover film.

16. The arrangement of claim 1, wherein an edge of said cutout bears to the extent of no more than about 50% directly against the respective power semiconductor module and the remaining part of said edge is at a distance of at least 2 mm from said respective power semiconductor module.

17. The arrangement of claim 16, wherein said edge of said cutout bears to the extent of no more than about 25% directly against the respective power semiconductor module.

18. The arrangement of claim 1, wherein said cover layer is thinner than said interlayer.

19. The arrangement of claim 18, wherein said cover layer has a thickness of between about 0.2 mm and about 1 mm and said interlayer has a thickness of between about 0.5 and about 3 mm.

* * * * *